US010407934B2

(12) United States Patent
Wastel

(10) Patent No.: US 10,407,934 B2
(45) Date of Patent: Sep. 10, 2019

(54) SAFETY BARRIER FOR AUTOMATED VEHICLE PARKING FACILITY

(71) Applicant: Park Plus, Inc., Oakland, NJ (US)

(72) Inventor: Andreas N. Wastel, Randolph, NJ (US)

(73) Assignee: Park Plus, Inc., Fairview, NJ (US)

( * ) Notice: Subject to any disclaimer, the term of this patent is extended or adjusted under 35 U.S.C. 154(b) by 0 days.

(21) Appl. No.: 15/689,053

(22) Filed: Aug. 29, 2017

(65) Prior Publication Data

US 2017/0356213 A1 Dec. 14, 2017

Related U.S. Application Data

(63) Continuation-in-part of application No. 15/019,035, filed on Feb. 9, 2016, now Pat. No. 9,752,341.

(51) Int. Cl.

| | |
|---|---|
| ***E04H 6/42*** | (2006.01) |
| ***E04F 11/18*** | (2006.01) |
| ***E04G 21/32*** | (2006.01) |
| ***E04H 6/08*** | (2006.01) |
| ***E06B 11/02*** | (2006.01) |
| ***E05F 15/665*** | (2015.01) |
| ***E05F 15/681*** | (2015.01) |
| ***E05F 15/70*** | (2015.01) |

(52) U.S. Cl.

CPC ..... *E04H 6/42* (2013.01); *E04F 11/18* (2013.01); *E04G 21/3223* (2013.01); *E04H 6/08* (2013.01); *E05F 15/665* (2015.01); *E05F 15/681* (2015.01); *E05F 15/70* (2015.01); *E06B 11/025* (2013.01); *E04F 2011/1876* (2013.01)

(58) Field of Classification Search

None

See application file for complete search history.

(56) References Cited

U.S. PATENT DOCUMENTS

| | | | | |
|---|---|---|---|---|
| 1,650,134 | A * | 11/1927 | Kintner | E06B 9/063 160/34 |
| 3,088,605 | A * | 5/1963 | Martinson | E04H 6/183 414/231 |
| 3,378,059 | A * | 4/1968 | Young | E06B 3/483 160/165 |
| 4,460,030 | A * | 7/1984 | Tsunemura | E05D 15/242 160/35 |
| 7,739,834 | B2 * | 6/2010 | Stoffels | E01F 13/06 49/233 |
| 9,517,778 | B2 * | 12/2016 | Thompson | E01F 13/046 |
| 2013/0085596 | A1 * | 4/2013 | Shani | E04H 6/285 700/217 |

* cited by examiner

*Primary Examiner* — Marcus Menezes

(74) *Attorney, Agent, or Firm* — Gerald E. Hespos; Michael J. Porco; Matthew T. Hespos

(57) ABSTRACT

A safety barrier assembly for a parking garage is positioned in proximity to an opening in a floor of the parking garage that accommodates vertical movement of a VRC between floors of the parking garage. The safety barrier assembly has left and right vertical guide columns. A handrail and a knee rail have opposite ends guided for vertical movement in the columns. A bottom rail is connected pivotally to the knee rail and hangs to a position below the knee rail when the knee rail is in the lower position. An actuator causes the bottom rail to pivot up as the knee rail is elevated.

6 Claims, 2 Drawing Sheets

SAFETY BARRIER FOR AUTOMATED VEHICLE PARKING FACILITY

This Application is a continuation-in-part of application Ser. No. 15/019,035, filed Feb. 9, 2016 (now U.S. Pat. No. 9,752,341), the entire disclosure of which is incorporated herein by reference.

BACKGROUND

Field of the Invention

The invention relates to an automated parking facility with vertically reciprocating conveyors and automated safety barriers for protecting employees and emergency personnel from inadvertently falling into the opening required for the vertically reciprocating conveyor.

Description of the Related Art

There are at least two types of automated parking facilities that enable a vehicle to be parked and retrieved without human intervention. One type of automated parking facility uses at least one automated guided vehicle (AGV). The facility has at least one access point that enables a vehicle to be driven onto a parking platform or pallet that is elevated a relatively short distance from the floor or other supporting surface. The AGV moves under the pallet and lifts the pallet with the vehicle thereon. The AGV then moves to an appropriate vacant parking spot in the facility and deposits the pallet and the vehicle at that parking spot. The AGV then moves away from the pallet and vehicle to another specified location for picking up and moving another pallet/vehicle combination. The AGV will return to the previously parked pallet and vehicle when the vehicle owner returns to retrieve the vehicle. More particularly, the AGV will move beneath the pallet, lift the pallet and vehicle, and return to the access point of the parking facility. A parking system of this type is disclosed, for example, in U.S. Pat. No. 9,670,690, the contents of which are incorporated herein by reference.

The typical automated parking facility will have several parking levels and at least one vertically reciprocating conveyor (VRC) for moving vehicles vertically between the floors or levels of the parking facility. A VRC is functionally similar to a conventional passenger elevator. However, the platform of the VRC that moves the vehicles vertically generally does not have side walls or a ceiling. Additionally, the openings in each floor that permit the vertical movement of the VRC platform are not surrounded by walls on that floor and there is no door that must be opened to access the platform of the VRC on each floor. The parent to this application addressed safety concerns relating to openings in the floors for accommodating movement of the VRC platform. More particularly, there was a concern that a malfunctioning AGV might inadvertently move into the opening that accommodates the vertical movement of the VRC platform, and hence the AGV could fall several floors, thereby causing significant damage with a risk of personal injury to people on lower floors. Additionally, there was a concern that workers or emergency personnel could fall into the opening if the area was poorly lit or subjected to a smoke condition. Accordingly, the parent to this application disclosed an arrangement that had a sufficiently large beam to prevent an AGV from driving over the beam and into the opening of the floor. Additionally, upper and lower pedestrian safety barriers were telescoped into openings in the safety beam at heights that would define a knee rail and a hand rail to prevent pedestrians from falling into the opening. Thus, the beam for stopping the AGV also would function to stop a person who was belly-crawling on the floor in a smoke condition. The knee rail would stop a worker who was crawling on hands and knees, while the handrail would stop a worker who was walking in a no-light or low-light condition. The safety barrier disclosed in the parent application has been found to work very well.

Another type of automated parking facility is referred to as a rack and roll system and does not use a parking pallet that stays with the vehicle and does not use AGV's. Rather, the access point may have a comb-like floor with interdigitated teeth. The comb-like structure in the floor lifts the vehicle a small distance and transport the vehicle horizontally into the VRC. The VRC moves the vehicle vertically to the appropriate parking level. Apparatus at the parking level then moves the vehicle horizontally away from the VRC and into an appropriate parking space. The rack and roll automated parking system does not require dedicated AGV travel lanes on each parking level and hence can provide a more dense population of parked vehicles on each parking level. Additionally, the rack and roll parking system does not require the vehicle to be supported on a parking pallet that is elevated sufficiently to accommodate an AGV beneath the pallet. As a result, the vertical spacing between parking levels can be smaller in a rack and roll automated parking facility than in an automated parking facility that utilizes AGV's.

Rack and roll automated parking facilities do not utilize AGV's, and therefore do not require a protective beam to ensure that a malfunctioning AGV does not fall into the opening in the floor that accommodates the vertically moving platforms of the VRC. However, there is still the concern that workers or emergency personnel who must be in the facility during low-light or no-light situations could inadvertently fall into the opening in the floor for accommodating the VRC platforms. The safety barrier disclosed in the parent application would work well to protect workers or emergency personnel in a rack and roll parking facility. However, the beam that is intended to stop an errant AGV and that is sufficiently large to accommodate the telescoping safety barriers adds significantly to the required height for the parking floor. Accordingly, there is a demand for a low profile safety barrier to prevent workers and emergency personnel who may be belly-crawling, crawling on hands and knees or walking upright in a no-light or low-light situation.

SUMMARY OF THE INVENTION

The invention relates to safety barrier assemblies for an automated parking system with a parking structure that has plural levels or floors and a vertically reciprocating conveyor (VRC) for transporting vehicles vertically in the facility. The VRC requires an opening in each floor of the parking facility to accommodate the vertical movement of vehicles between the floors. The safety barrier assembly is configured to prevent workers or emergency personnel who are in the parking facility during no-light or low-light situations from falling inadvertently into the opening for the VRC. More particularly, the safety barrier assembly is configured to provide protection at three height levels to block a person who is belly-crawling, to block a person who is crawling on hands and knees and to block a person who is walking erect. Additionally, the safety barrier assembly is configured to provide a low height profile when elevated and not in use.

The safety barrier assembly includes left and right vertical guide columns at opposite left and right sides of the VRC floor opening and at a position between the VRC opening and an area of the floor from which a crawling or walking person is likely to approach the opening. The left and right guide columns include vertical channels for guiding the vertical movement of the movable components of safety barrier assembly. A motor may be mounted to one or both of the vertical guide columns and may be operative for moving chains vertically in or adjacent to the columns. A single motor may be provided on one column for moving chains on both columns.

The safety barrier assembly includes a rigid horizontally oriented handrail and a rigid horizontally oriented knee rail each of which is mounted for vertical movement along the guide columns. The handrail and the knee rail can move to a maximum height position that permits a vehicle to be moved to or from the VRC between the vertical guide columns and beneath the elevated handrail and knee rail. The handrail and the knee rail are parallel to one another and substantially adjacent to one another at the same height position when the handrail and knee rail are in their maximum elevated position. This position is maintained when the VRC is substantially aligned with the floor for depositing or removing a vehicle from that floor in the parking facility. This movement of the handrail and guide rail to their elevated position may be triggered by a sensor that senses the alignment of the VRC platform at or near the floor. The sensor then causes the motor on the vertical guide column to operate for moving the chains and causing the handrail and knee rail to be elevated.

The vertical guide columns may have stops for defining a lowermost position of the respective handrail and knee rail along the vertical guide columns. The stops for the handrail are higher than the stops for the knee rail. For example, the stops may be positioned to terminate the downward movement of the handrail at roughly a waist or chest position for contacting a walking person. More particularly, the handrail may be stopped at a bottom position of approximately 3 feet to 4 feet from the floor. The knee rail, however, may be stopped at a bottom position of approximately 1.5 feet to 2 feet from the floor.

Upward vertical movement of the handrail and knee rail may be carried out by having the chain or chains act only on the knee rail. With this embodiment, the ends of the knee rail at or near the vertical guide columns may be configured to engage adjacent areas of the handrail as the knee rail is being lifted up. Thus, the engagement of the knee rail with the handrail will cause the knee rail to lift the handrail vertically up with the knee rail. During downward movement, the chains or other driving mechanism will lower the knee rail. The handrail will follow the knee rail gravitationally until the handrail engages the handrail stops in the vertical guide columns. The knee rail will continue its downward movement after the handrail is stopped by the handrail stops in the vertical guide columns. However, the knee rail will eventually contact the knee rail stops so that additional downward movement of the knee rail stops in the vertical guide columns.

The safety barrier assembly described is sufficient for stopping a person who is walking or a person who is crawling on hands and knees. However, emergency personnel such as firemen are likely to belly crawl if there is a smoke condition. The smoke will impede vision, and hence the crawling emergency worker could crawl beneath the knee rail and fall into the opening that is provided in the floor for accommodating the VRC. Accordingly, the safety barrier assembly may further include a bottom rail mounted pivotally to the knee rail. The bottom rail may extend horizontally and may be an extruded or formed tube. Arms extended rigidly from opposite ends of the bottom rail and are connected pivotally to areas of the knee rail near the vertical guide columns. The arms have lengths to permit the bottom rail to pivot gravitationally down and into a position between the floor and the knee rail when the knee rail is in the lower position. Actuators may extend rigidly from the arms in directions generally away from the bottom rail. The actuators are configured to engage the handrail as the knee rail is being moved vertically up toward the handrail. This contact of the actuators with the handrail will cause the bottom rail to pivot up into a height position substantially corresponding to the height positions of the knee rail and handrail during that part of the vertical movement of the knee rail where the knee rail and handrail move in unison.

With the above-described arrangement, three horizontal safety rails are provided at three different height positions corresponding respectively to a belly crawling person, a person crawling on their hands and knees and a person walking erect when the safety barrier assembly is in its lowest position. However, the handrail, the knee rail and the bottom barrier will be substantially aligned with one another at the same height position when the safety barrier assembly is in the elevated position occurring when the VRC is at or near the floor. As a result, the bottom rail will not contribute to a reduction in the space available for accommodating the movement of vehicles onto and off of the VRC when the safety barrier assembly is in the elevated position. Additionally, the low profile of the safety barrier assembly in the elevated position can reduce the floor to ceiling height at each level of the parking facility so that more levels can be provided. Still further, the bottom rail need not be sufficiently massive to stop an AGV, and the handrail and the knee rail do not need vertical legs. Therefore, material costs are low, and a smaller less expensive motor is required to move the smaller lighter safety barrier assembly.

DETAILED DESCRIPTION

Figure 1:
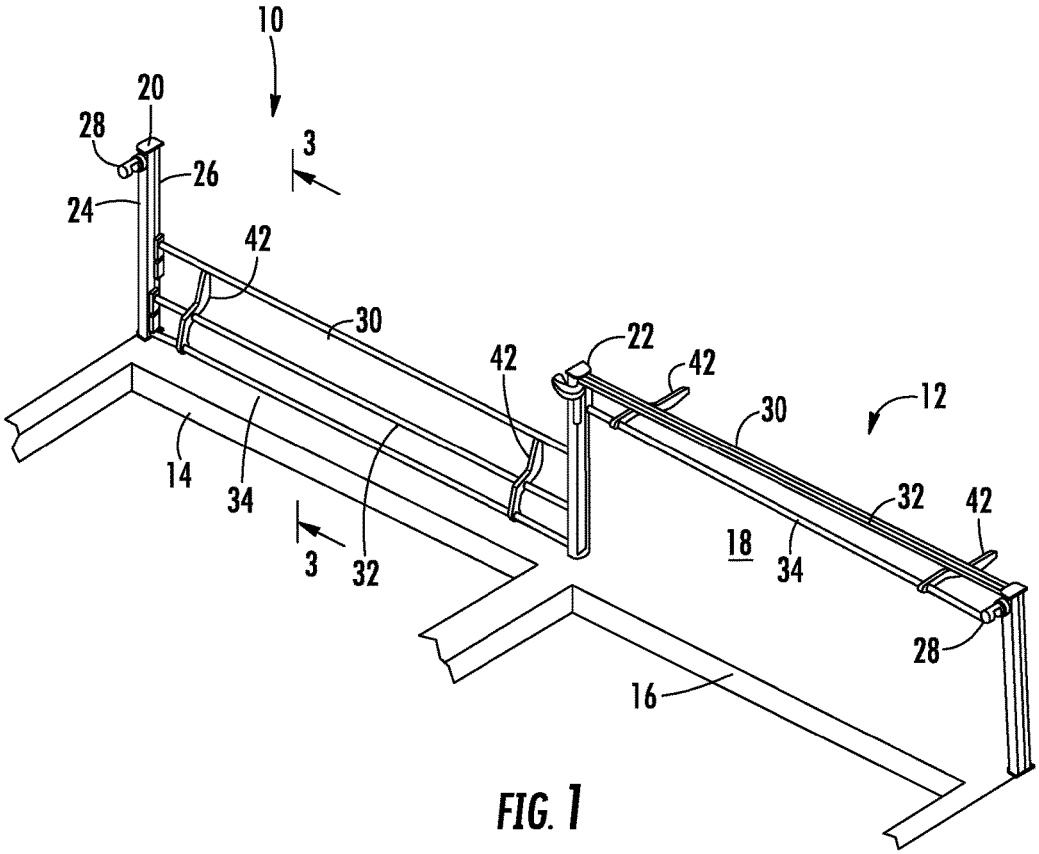
FIG. 1 is a perspective view of a safety barrier assembly in accordance with the invention.
Figure 2:
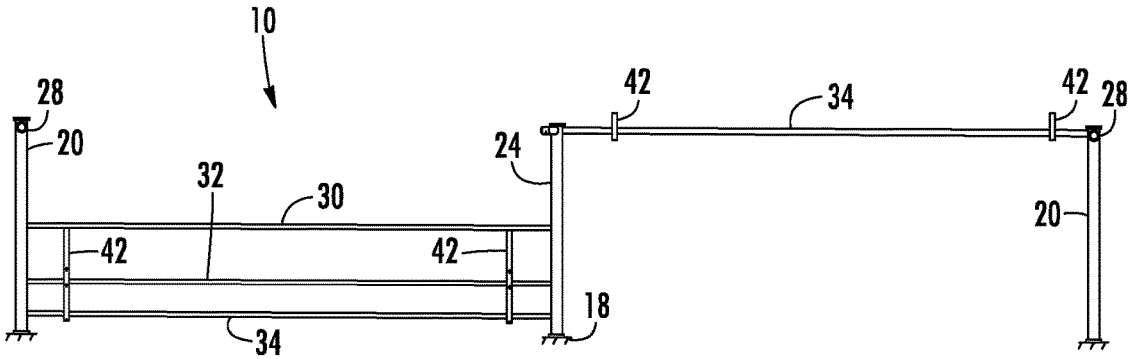
FIG. 2 is a front elevational view of the safety barrier assembly of FIG. 1.

FIGS. 1 and 2 illustrate two adjacent safety barrier assemblies 10 and 12 in proximity to two openings 14 and 16 in a floor 18 of a parking facility. The safety barrier assemblies 10 and 12 are of identical configurations but are illustrated at different height positions. In view of the identical nature of the safety barrier assemblies 10 and 12, only the safety barrier assembly 10 will be described herein.

The safety barrier assembly 10 includes first and second vertical guide columns 20 and 22 supported rigidly on the floor 18 and extending vertically toward a ceiling (not shown). The first vertical guide column 20 is formed with two vertical guides 24 and 26 extending from the floor 18 to the top end of the first vertical guide column 20. Identical guides are formed in the second vertical guide column 22, but are not visible in the figures. A motor 28 is mounted near the top end of the first vertical guide column 20 and is operative to drive chains for vertical movement along the first and second vertical guide columns 20 and 22.

The safety barrier assembly 10 further includes a handrail 30, a knee rail 32 and a bottom rail 34, all of which extend horizontally parallel to one another and substantially perpendicular to the vertical guide columns 20 and 22. The handrail 30 has a first longitudinal end mounted in the guide 26 of the first vertical guide column 20 and has an opposite second end mounted in the corresponding guide of second vertical guide column 22 to permit a guided vertical displacement of the handrail 30 relative to the vertical guide columns 20 and 22. Similarly, the knee rail 32 has a first longitudinal end mounted in the guide rail 24 of the first vertical guide column 20 and an opposite second end mounted into the corresponding guide of the second vertical guide column 22. Thus, the knee rail 32 also is guided for vertical movement along the first and second guide columns 20 and 22.

Figure 3:
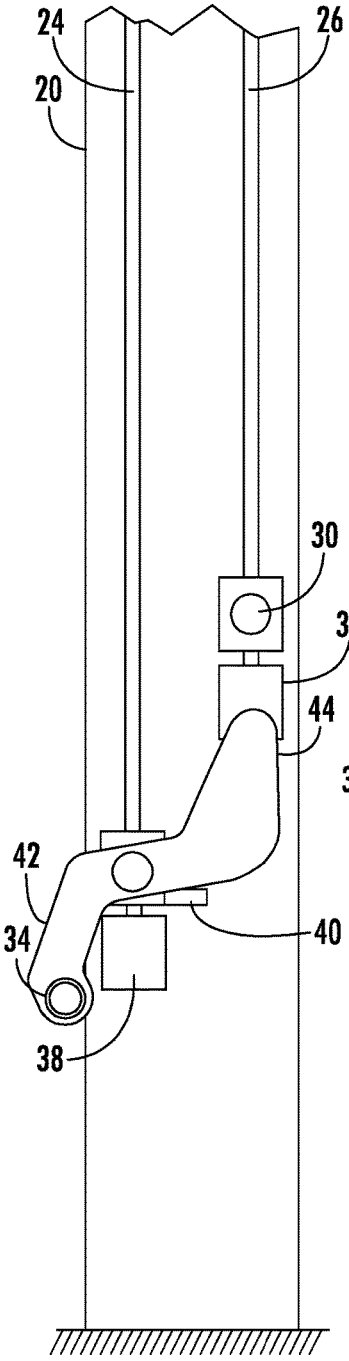
FIG. 3 is a cross-sectional view taken along line 3-3 of FIG. 2 and showing the safety barrier assembly in its lowest position.

As shown in FIG. 3, the first vertical guide column 20 has a handrail stop 36 that limits the downward movement of the handrail 30 relative to the first vertical guide column 20. Similarly, the first vertical guide column 20 has a knee rail stop 38 for limiting downward movement of the knee rail 32. The handrail stop 36 is higher than the knee rail stop 38. In this embodiment, the handrail stop 36 stops the downward movement of the handrail 30 at a height of approximately 3' 6" above the floor 18. On the other hand, the knee rail stop 38 stops the downward movement of the knee rail" at a height of about 1' 9" above the floor 18.

Figure 5:
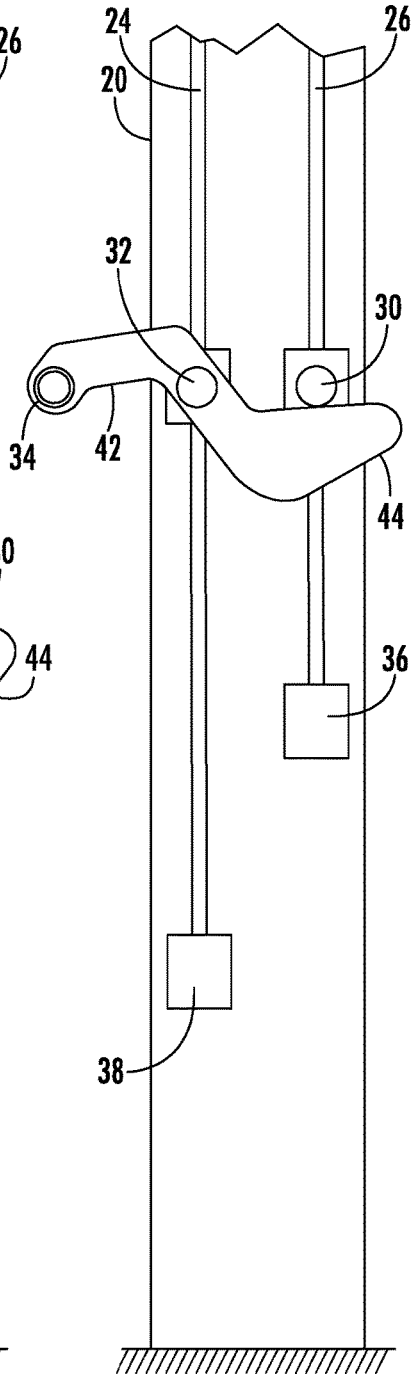
FIG. 5 is a cross-sectional view similar to FIGS. 3 and 4, but showing the handrail, the knee rail and the bottom rail elevated sufficiently to be at substantially the same height.

The motor 28 drives at least one chain that is connected to the knee rail 32 to raise or lower the knee rail 32. In one embodiment, the motor 28 drives two chains for driving opposite ends of the knee rail 32. In this regard, one of the chains may be guided horizontally between the top end of the first vertical guide column 20 and the top end of the second vertical guide column 22. The chain that extends to the second vertical guide column 22 then will continue down to connect to the end of the knee rail 32 at the second vertical guide column 22. The handrail 30 is not driven directly by the motor 28. Rather, the ends of the knee rail 32 have rigid projections 40 that extend sufficiently far to engage the underside of the handrail 30 after sufficient upward movement of the knee rail 32. Thus, the projection 40 will apply the lifting forces generated by the motor 28 to the handrail 30 so that after a sufficient upward movement of the knee rail 32, the handrail 30 and the knee rail 32 will move simultaneously up at substantially identical heights, as shown in FIG. 5

Figure 4:
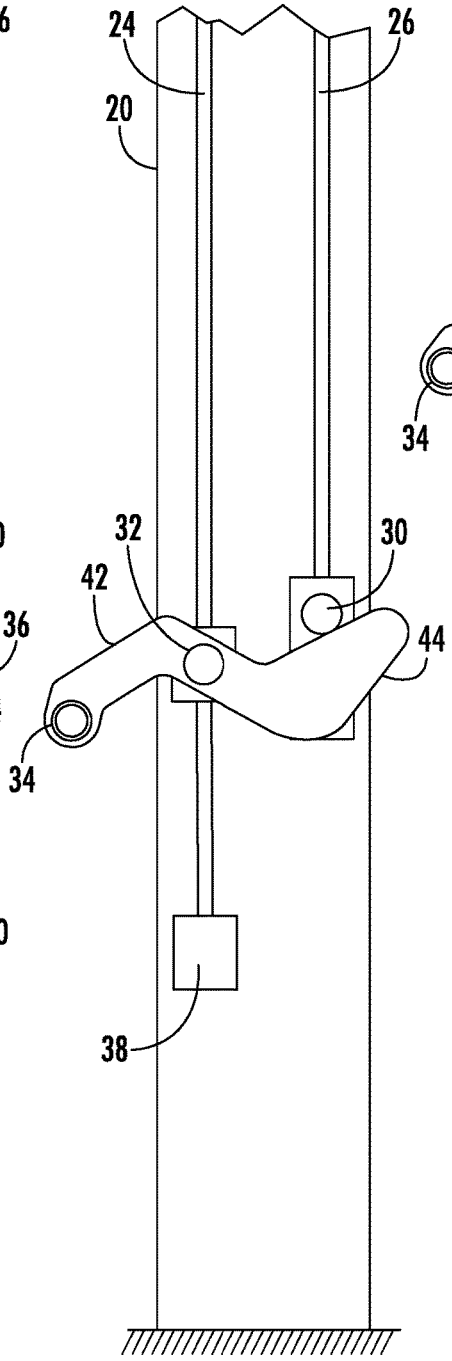
FIG. 4 is a cross-sectional view similar to FIG. 3, but showing the knee rail elevated into a position where the knee rail is about to lift the handrail and where the bottom barrier is about to be pivoted up.

The bottom rail 34 is connected pivotally to the knee rail 32 by arms 42 at opposite ends of the knee rail 32 and the bottom rail 34. The arms 42 permit the bottom rail 34 to pivot down into a position approximately halfway between the knee rail 32 and the floor 18 when the knee rail 32 is in its lowest position, as illustrated in FIG. 3. An actuator 44 extends from the knee rail 32 in a direction generally opposite the direction of the arm 42. The actuator 44 extends sufficiently far to contact the handrail 30 when the motor 28 is lifting the knee rail 32 up, as shown in FIG. 4. Further upward movement will cause the bottom barrier 34 to pivot about the knee rail 32 and into the position shown in FIG. 5 where the handrail 30, the knee rail 32 and the bottom rail 34 are at substantially the same heights and will continue at that common height alignment as the knee rail 32 is being pulled up along in the first and second vertical guide columns 20 and 22 toward the maximum elevation.

In accordance with the subject invention, the bottom rail 34 stops or warns a person belly-crawling along the floor 18 of the presence of the opening 14 or 16 in the floor to accommodate the VRC. Simultaneously, the knee rail 32 will be contacted by a person crawling on hands and knees to prevent inadvertent movement into the opening 14 or 16. Still further, the handrail 30 will be contacted by a person who is walking. The handrail 30, the knee rail 32 and the bottom rail 34 have a low profile and are at a substantially constant height at their uppermost position so that movement of the vehicle between the vertical guide columns 20 and 22 is not impeded.

The invention has been described with respect to certain preferred embodiments. However, other changes within the scope of the invention will be apparent to those skilled in the art after having read this description of the preferred embodiments and the accompanying drawings.

What is claimed is:

1. A safety barrier assembly for a vehicle parking garage having a vertically reciprocating conveyor (VRC) and at least one opening in at least one floor of the parking garage for accommodating vertical movement of the vertically reciprocating conveyor, the safety barrier assembly being positioned in proximity to the opening and comprising:

left and right vertical guide columns;

a substantially horizontal handrail having opposite left and right ends movably engaged in the respective left and right vertical guide columns and movable between upper and lower handrail positions;

a substantially horizontal knee rail having opposite left and right ends movably engaged in the respective left and right vertical guide columns and movable between upper and lower knee rail positions, the lower knee rail position being lower than the lower handrail position;

left and right arms, each of the left and right arms having opposite first and second ends and an intermediate position between the first and second ends, the intermediate position of each of the left and right arms being pivotally connected respectively to left and right positions on the knee rail, the first end of each of the arms defining an actuator extending into a position vertically below the hand rail; and a substantially horizontal bottom rail connected to the first ends of the left and right arms for pivotal movement with the left and right arms around the knee rail so that the bottom rail is movable between upper and lower bottom rail positions as the left and right arms pivot around the knee rail, the bottom rail being in the lower bottom rail position and spaced above the floor when the knee rail is in the lower knee rail position, wherein the left and right arms pivoting the bottom rail into the upper bottom rail position as the knee rail approaches the upper knee rail position.

2. The safety barrier assembly of claim 1, further comprising at least one hand rail stop on at least one of the vertical guide columns for preventing movement of the handrail below the lower handrail position.

3. The safety barrier assembly of claim 2, further comprising at least one knee rail stop on at least one of the vertical guide columns for preventing movement of the knee rail below the lower knee rail position.

4. The safety barrier assembly of claim 1, further comprising at least one motor for selectively moving at least the knee rail between the lower and upper knee rail positions.

5. The safety barrier assembly of claim 4, wherein the at least one motor is mounted in proximity to an upper end of at least one of the vertical guide columns.

6. The safety barrier assembly of claim 1, wherein the handrail, the knee rail and the bottom rail are at substantially equal distances from the floor when the knee rail is in the upper knee rail position.

* * * * *